United States Patent [19]

Brown

[11] 4,400,876

[45] Aug. 30, 1983

[54] SPRING DEVICES

[76] Inventor: Frank R. Brown, Brookfield, Conn. 06804

[21] Appl. No.: 315,013

[22] Filed: Oct. 26, 1981

[51] Int. Cl.[3] ..... B26B 13/16

[52] U.S. Cl. ..... 30/186; 30/261; 267/158

[58] Field of Search ..... 267/158; 30/261, 231, 30/253, 186, 191, 193; 81/417

[56] References Cited

U.S. PATENT DOCUMENTS

| | | | |
|---|---|---|---|
| 929,749 | 8/1909 | Bishop | 30/261 X |
| 1,612,606 | 12/1926 | Carlson | 30/261 X |
| 2,505,705 | 4/1950 | Cohn | 30/261 X |
| 2,566,886 | 9/1951 | Hartman | 267/158 X |
| 2,881,696 | 4/1959 | Poth | 81/417 X |
| 3,176,551 | 4/1965 | Hansen | 81/417 X |
| 3,774,301 | 11/1973 | Brown | 30/186 |

*Primary Examiner*—Jimmy C. Peters
*Attorney, Agent, or Firm*—William G. Rhines

[57] ABSTRACT

A spring, particularly adapted for use with hand tools, comprising springy material formed into a flat, V-shaped configuration wherein the end region of one of the arms is adapted for removeable affixation to one of the elements to which the spring is to provide bias, and the other is adapted to impart bias to another of such elements, upon its outermost end being impinged upon by said other element as the two elements are moved pivotally toward each other.

11 Claims, 3 Drawing Figures

SPRING DEVICES

BACKGROUND OF INVENTION

In the field of apparatus having relatively moveable elements, it is frequently desired to impart bias to such elements, as by the use of springs. Thus, hand tools, such as wire cutters, may desirably have their handles biased against being squeezed toward each other to provide a means for opening the cutters when the squeezing motion is released. Typically, coil or leaf springs or other such devices are utilized for such purposes. In this connection, reference is made to the following United States patents: Brown U.S. Pat. No. 3,774,301; Angquist U.S. Pat. No. 3,398,451; Harvey U.S. Pat. No. 1,957,589; Rauh U.S. Pat. No. 1,870,025; Klein U.S. Pat. No. 2,938,266; Howe U.S. Pat. No. 641,966; Fisher U.S. Pat. No. 663,565; Carlson U.S. Pat. No. 848,966; Burkhart U.S. Pat. No. 908,947; Allison U.S. Pat. No. 1,007,836; Gordon U.S. Pat. No. 1,108,572; McKenney U.S. Pat. No. 1,572,546; Parcell U.S. Pat. No. 1,779,889; and Jansson U.S. Pat. No. 4,074,597.

Prior art devices present objectionable drawbacks, including cost and complexity to produce, difficulty to affix, and/or remove or replace, physical interference with the operability of moveable parts, unsightly appearance, tending to entangle with other objects, etc.

Accordingly, it is an objection of this invention to provide spring means for imparting bias to relatively moveable members.

It is a further objective to supply such means in a form which is simple structurally, and inexpensive and easy to produce.

Another object is to provide means for satisfying the foregoing objectives while being easy to affix to and/or be removed from said members.

Still another object is to supply means for satisfying the foregoing objectives which will present minimal or no physical interference with the operability of said members.

STATEMENT OF INVENTION

Desired objectives may be achieved through practice of the present invention, embodiments of which include flat, V-shaped structures formed from springy material wherein the outermost region of one of the arms of the structure is adapted for removeable affixation to a first member and the outermost end region of the other of said arms is adapted to be impinged upon by another member which is moveable relative to said first member, causing said arm end regions to move toward each other, whereby spring bias may be imparted to said members to bias them toward movement away from each other.

DESCRIPTION OF DRAWINGS

This invention may be understood from the description and claims which follow, and from the accompanying drawings in which

DESCRIPTION OF PREFERRED EMBODIMENTS

Figure 1:
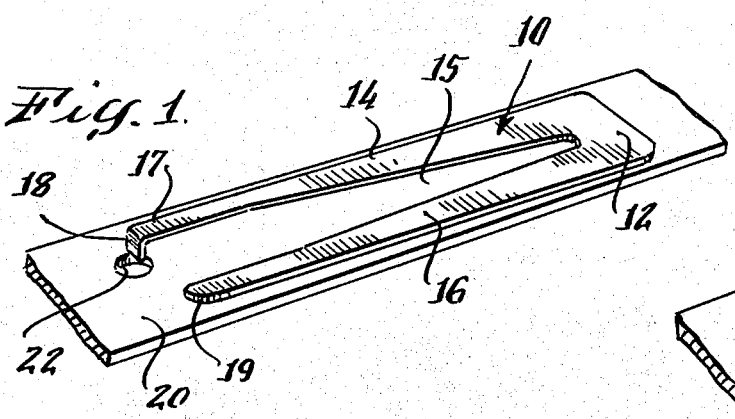
FIG. 1 is a perspective view of an embodiment of this invention.

Referring first to FIG. 1, there is depicted a spring 10 which embodies the present invention. It may be formed from any of a variety of materials having the desired properties of formability and springiness, but it has been found particularly advantageous to stamp such embodiments from rolled edge spring steel approximately 0.025 inches thick. Of course, embodiments may be made in any of a wide variety of dimensional ranges as well, but it has been found advantageous to form such embodiments for use with items such as hand-held wire cutters to an overall finished length of 1.739 inches and an overall width of 0.320 inches.

As shown in FIG. 1, the spring 10 comprises a base portion 12, from which extend elongated spring arms 14,16. The axial configuration of the arms may be of a variety of configurations, but usually are straight, as shown in FIG. 1, or may be more or less arcuate. Further, the contour of the lateral edges of the arms may be any of a wide variety of shapes, but usually they will be curved or, preferably, as shown in FIG. 1, straight. The width of each of the arms may be the same at the base as at the outermost end, or less, or, preferably as shown in FIG. 1, wider. The configurations shown in FIG. 1 are preferred because they provide for uniform flexing in spring action as hereinafter described, so that good performance is achieved, while at the same time facilitating production of the devices at low cost.

The outermost end 17 of one of the arms 14 is adapted for affixation, and preferably removeable affixation, to the device with which it is to be associated and used. As shown in FIG. 1, it may be formed from the end 17 of the arm 14 itself as a bent-over tab 18, as this is a comparatively easy and effective manner of achieving the desired result where other means are available for holding the device in place, since such a tab may be produced utilizing punching or stamping techniques and processes which are known per se. A useful configuration for such tabs, particularly for the use hereinafter described, has been found to be with a width of 0.070 inches, a length of 0.100 inches, and at a 90° angle to the plane of the arm 14.

Figure 2:
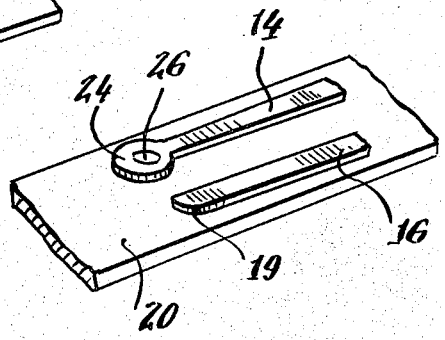
FIG. 2 is a perspective view of another embodiment of this invention.

In the form of the tab 18 shown in FIG. 1, it is readily adapted, for example, for insertion into a receiving hole 22 formed therefor in the device with which the spring is to be associated, such as a handle member 20 of a pair of hand-held pliers. The end 17 of the arm 14 may be adapted in other ways, however, for such affixation. For example, as shown in FIG. 2, the end of the arm 14 may be formed into a loop 24 which describes a hole or aperture 26, through which a rivet, or a bolt, or other fastening means may be inserted to affix it, or into which a pin or other projection from the associated device may be inserted.

The object as to all of the foregoing arm end adaptations is to affix it to the associated device, optionally moveably, but preferably removeably so as to facilitate easy removal and replacement of the spring if desired or necessary.

Optionally and preferably, the outermost end 19 of the other arm 16 is adapted for moving contact with a member of the device (e.g., a hand-held wire cutter) with which it is to be associated. Thus, as shown in FIG. 1, the outermost end of the arm 16 may be so adapted by being formed with a curved surface. In the utilization hereinafter described, a radius of 1/16 inch for such curve has been found to be satisfactory.

As previously noted, the embodiment of this invention shown in FIG. 1 has arms 14, 16 which are more narrow at their outer ends than in the region of the base 12. Since the outside edges of the arms 14, 16 are substantially parallel to each other, the arms form a V-shaped slot 15 between them which is narrower near the base region 12 than in the region of the outermost ends of the arms. This configuration has been found well suited for certain uses, such as with hand-held wire-cutters as hereinafter described, because it provides a good "fit" dimensionally with the operative elements of the device with which it is to be used, while, at the same time, providing space physically for the arms to deflect toward each other in use with substantially uniform increase in the amount of such deflection as a function of distance along the arms from the base region 12.

It should be noted that the arms 14, 16 are about the same in length. This feature is particularly advantageous in applications such as that described herein where the base 12 of the spring 10 is held in position by being inserted between the handle member 20 and its associated cover 40. The effect of such substantial equality in length of the spring arms 14, 16 is to cause little or no appreciable lateral displacement of the base 12 of the spring 10 as the two spring arms 14, 16 are flexed toward and/or away from each other. By this means, the base 12 need not be independently secured in place against such lateral deflection, but instead may be effectively captivated by such things as the cover 40 without the necessity of supplementing their inherent strength, comparatively low though it may be.

Further, as the top of the left-hand spring arm 16 is moved (as shown) clockwise, the base 12 of the spring 10 tends to move, if at all, counter-clockwise, thus tending to produce a net "can-celling" effect insofar as the contact point between the end 19 of the arm 16 and the edge 34 of the tool handle 30 is concerned. This, in turn, reduces the necessity for adapting the end 19 of the arm 16 for relative motion between it and the surface 34, as by rounding the end 19 off to form a cam surface as shown, although, as hereinafter discussed, such adaptation is easily and may desirably be incorporated into embodiments of this invention.

Figure 3:
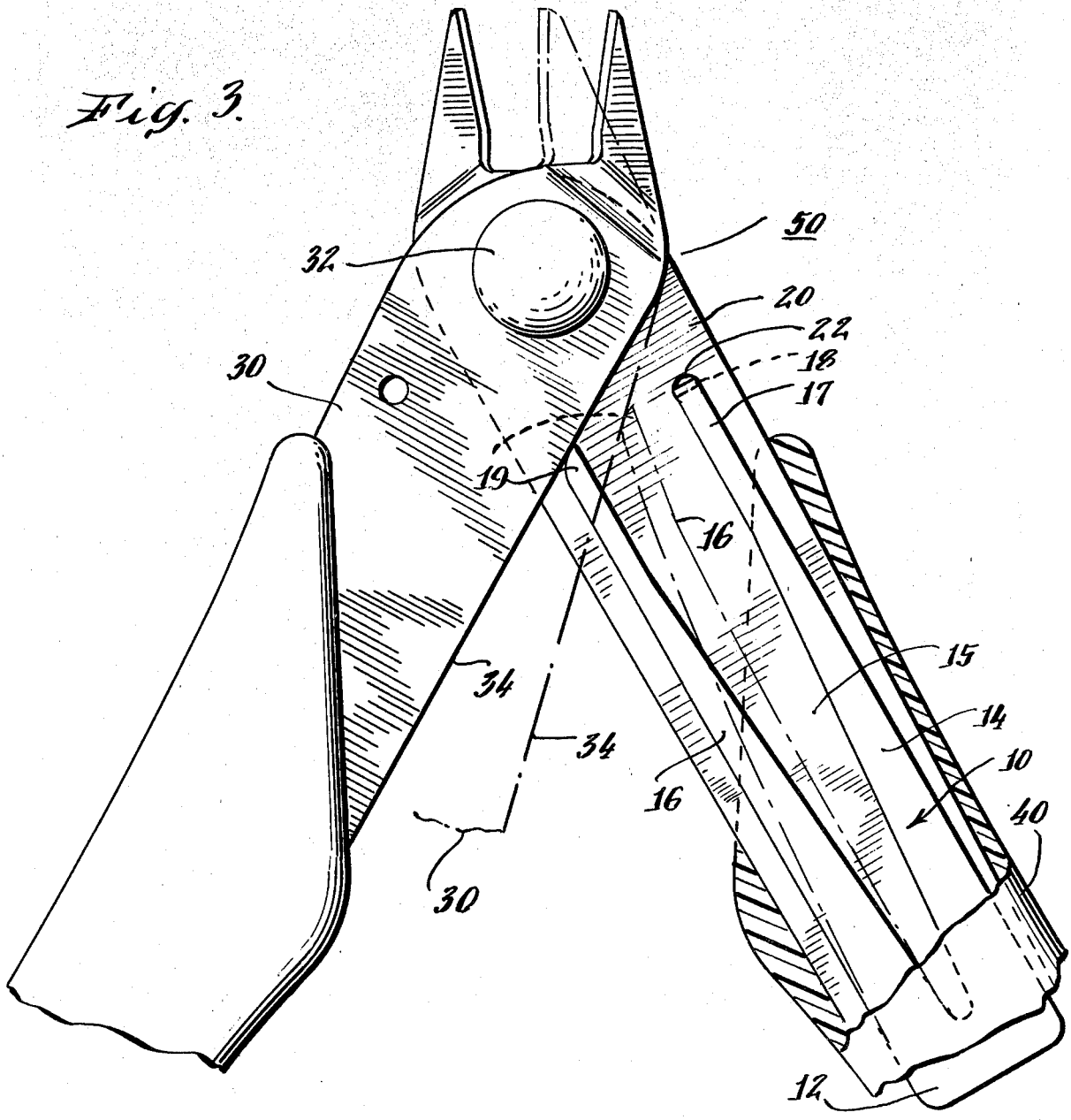
FIG. 3 depicts the embodiment of this invention shown in FIG. 1, in use.

FIG. 3 illustrates the embodiment of this invention shown in FIGS. 1 and 2, in use on a hand tool 50. In this figure, a pair of wire cutters is illustrated, but it is to be understood that devices embodying the present invention are not limited to wire cutters, or even to hand-operated tools generally, but may be utilized in any of a number of other and different applications as well, where it is desired to have spring means to impart bias to relatively moveable parts.

Illustrated in FIG. 3 are hand-held and operated wire cutters 50, comprised of two arms 20, 30, which are relatively and pivotally moveable with respect to each other about a pivot pin 32 in the form of a rivet, nut and bolt, or other means; all of which are known per se. As is typical in such cutter devices, each of the handle members 20, 30 has a cover 40 positioned over its handle end. Such cover may be made separately and be so positioned by being slipped into place, or may be applied by wrapping or dipping processes, or other known per se means. If they are of such a nature as not to be rigidly or impenetrably bonded to the handle surfaces, it is possible to slide the base end 12 of the spring 10 in between the outer surface of the handle member 20 and the interior of the handle cover 40, thus utilizing the latter as a means to hold the spring in place. Of course, if it is not possible to do so by that means, other means may be provided to achieve the same purposes. For example, a second fastener of any of a wide variety of known per se designs may be used or, as illustrated in FIG. 2, by adapting the arm itself for such affixation as by a rivet, screw, or other suitable means.

As positioned, the spring 10 is stabilized against moving when impinged upon by the tool handle member (3) other than the one (20) to which it is affixed. So positioned, it is substantially out of the way of interfering with the operation of the device or becoming entangled with other objects, since it lies flat against and contiguous with one of the surfaces of the handle member 20. In that position, the end 19 of the arm 16 will be impinged upon by one edge 34 of handle 30 as the handles 20, 30 are moved toward each other pivotally about the pivot 32 as the handles are squeezed manually toward each other (i.e., in the direction of the arrow in FIG. 3). Since the handle 30 overlays the handle 20, and the spring 10 overlays the same surface of the handle 20 as does the handle 30, the latter will so contact the spring 10 with the surface 19 of the spring 10 being impinged upon by the edge 34 of the handle 30. This causes the arm 16 of the spring 10 to deflect toward the arm 14, and the consequent counterdirectional spring action to spring bias the arms 14, 16 toward movement away from each other upon relaxation of the manual closing pressures on the handles 20, 30.

From the foregoing disclosure, it will be apparent that embodiments of this invention afford many advantages. They exhibit long life, with stresses distributed over the lengths of the spring arms, particularly where they are tapered in configuration as shown. They are inexpensive and technically easy to produce from standard stock using standard equipment, with little waste. They may be quickly and easily attached and replaced when desired, particularly when captivated by easily manipulated elements such as the handle covers as previously discussed. The spring force can be easily regulated by selection of the material for its characteristics and/or by adjusting its geometry and/or dimensions, which can further provide means for adjusting the size of the spring to better suit it as to available space, operability, appearance, etc.

Thus, it is to be understood that the embodiments of this invention herein disclosed and discussed are by way of illustration and not of limitation, and that a wide variety of embodiments may be made without departing from the spirit or scope of the invention.

I claim:

1. A spring device for imparting spring bias against the movement of two members toward each other comprising a flat continuum made from springy material having a base portion from which two elongated arms, each of which is wider at its base portion end than at its outermost end, and is separated from the other by a V-shaped slot, extend in substantially the same direction with respect to said base portion, the end region of one of said arms farthest from said base portion being adapted for affixation to the member with which it is to be associated, and the end region of the other of said arms that is farthest from said base portion being adapted to receive pressure laterally on the side thereof facing away from the other of said arms from being impinged upon by the other of said members.

2. The device described in claim 1 wherein the end region of said one arm is adapted for removeable affixation to said member.

3. The device described in claim 2 wherein the end of said one arm in said end region is bent over to form a tab which is at substantially right angles to said arm.

4. The device described in claim 2 wherein the end of said one arm in said end region is formed into a closed loop.

5. The device described in any of claims 1, 2, 3 or 4 wherein the end region of said other of said arms is adapted for being impinged upon by the other of said members along an arcuate surface.

6. The device described in any of claims 1, 2, 3, 4 or 5 wherein said arms are of substantially equal length.

7. A hand tool comprising two handle members pivotally mounted to each other, and a spring device for imparting spring bias against the movement of said members toward each other, said spring device comprising a flat continuum made from springy material having a base portion from which two elongated arms, each of which is wider at its base portion end than at its outermost end, and is separated from the other by a V-shaped slot, extend in substantially the same direction with respect to said base portion, the end region of one of said arms farthest from said base portion being adapted for affixation to the member with which it is to be associated, and the end region of the other of said arms that is farthest from said base portion being adapted to receive pressure laterally on the side thereof facing away from the other of said arms from being impinged upon by the other of said members.

8. The device described in claim 7 wherein the end region of said one arm is adapted for removeable affixation to said member.

9. The device described in claim 8 wherein the end of said one arm in said end region is bent over to form a tab which is at substantially right angles to said arm.

10. The device described in any of claims 7–9 wherein the end region of said other of said arms is adapted for being impinged upon by the other of said members along an arcuate surface.

11. The device described in any of claims 7–10 wherein said arms are of substantially equal length.

* * * * *